US009326574B2

(12) United States Patent
Dissegna

(10) Patent No.: US 9,326,574 B2
(45) Date of Patent: May 3, 2016

(54) SUITCASE

(71) Applicant: NILVIA S.N.C., Mussolente (IT)

(72) Inventor: Giusseppe Dissegna, Mussolente (IT)

(73) Assignee: NILVIA S.N.C., Mussolente (VI) (IT)

( * ) Notice: Subject to any disclaimer, the term of this patent is extended or adjusted under 35 U.S.C. 154(b) by 0 days.

(21) Appl. No.: 14/654,724

(22) PCT Filed: Dec. 6, 2013

(86) PCT No.: PCT/IT2013/000341

§ 371 (c)(1),
(2) Date: Jun. 22, 2015

(87) PCT Pub. No.: WO2014/097337

PCT Pub. Date: Jun. 26, 2014

(65) Prior Publication Data

US 2015/0313336 A1 Nov. 5, 2015

(30) Foreign Application Priority Data

Dec. 21, 2012 (IT) ..... VI2012A0343

(51) Int. Cl.
*A45C 5/03* (2006.01)
*A45C 13/02* (2006.01)
*A45C 5/14* (2006.01)

(52) U.S. Cl.
CPC ... *A45C 5/03* (2013.01); *A45C 5/14* (2013.01); *A45C 13/02* (2013.01); *A45C 2013/025* (2013.01)

(58) Field of Classification Search
CPC .... A45C 2011/003; A45C 5/03; A45C 13/02; A45C 2013/025
USPC ..... 190/109, 111; 150/133
See application file for complete search history.

(56) References Cited

U.S. PATENT DOCUMENTS 4,828,081 A * 5/1989 Nordstrom et al. ..... A45F 3/02 190/102
5,217,119 A * 6/1993 Hollingsworth ..... G06F 1/1628 190/102

(Continued)

FOREIGN PATENT DOCUMENTS

WO 2006/082659 A1 8/2006
WO 2012/143521 A1 10/2012

OTHER PUBLICATIONS

International Search Report dated Apr. 7, 2014 from corresponding International Application No. PCT/IT2013/000341; 3 pgs.

(Continued)

*Primary Examiner* — Sue A Weaver
(74) *Attorney, Agent, or Firm* — Maier & Maier, PLLC

(57) ABSTRACT

A suitcase with a hollow container body defining an internal compartment and having: a supporting wall; an upper wall opposite to the supporting wall; a first opening, closable, for accessing the compartment. The upper wall has two edges adjacent each other and delimiting a second opening closable and central to said top wall. The suitcase further comprises a support having two flaps folded one over the other to form a U-shaped pocket which divides the compartment in two half-compartments. Each of the flaps is associated with a corresponding edge of the top wall and at least a first flap is slidable with respect to its corresponding first edge to reduce or extend the depth of the pocket for the extraction/housing of a product in the latter.

9 Claims, 2 Drawing Sheets

(56) References Cited

U.S. PATENT DOCUMENTS

| | | | | |
|---|---|---|---|---|
| 6,105,764 | A | 8/2000 | Scicluna et al. | |
| 6,581,736 | B1 * | 6/2003 | Scicluna | A45C 13/40 150/106 |
| 6,948,600 | B2 * | 9/2005 | Chuang | A45C 3/02 150/116 |
| 7,588,146 | B1 | 9/2009 | Salander et al. | |
| 2011/0198374 | A1 | 8/2011 | Majeau | |

OTHER PUBLICATIONS

Italian Search Report dated Jul. 23, 2013 from corresponding Italian Application No. IT VI2012A000343; 2 pgs.

* cited by examiner

SUITCASE

CROSS REFERENCE TO RELATED APPLICATIONS

This application is based upon and claims the benefit of priority from the prior Italian Patent Application No. VI2012A000343, filed on Dec. 21, 2012, and International Patent Application No. PCT/IT2013/000341, filed on Dec. 6, 2013, the entire contents of which are incorporated herein by reference.

FIELD

The exemplary embodiment relate to a suitcase.

In particular, the exemplary embodiment concerns a suitcase with wheels and/or shoes to facilitate the dragging on the ground.

Therefore the exemplary embodiment relate to the field of suitcases and in general of the containers for transporting personal belongings.

BACKGROUND

Nowadays, in the field of medium-sized suitcases are known the trolleys, namely suitcases that have, associated to a container body, an extensible grip portion and wheels and/or shoes for resting on the ground.

This type of suitcase generally has a semi-rigid container body able to maintain, even when it is empty, a parallelepiped shape and to provide a moderate protection to the content thereof.

Nowadays electronic devices such as laptop computers and electronic tablets are very popular.

These electronic devices are fragile and must be protected from impact or stress that may damage them.

Therefore, in case of voyages, it is felt the need to shelter such devices in your own suitcase easily and safely.

Until now, such a need is lest unsatisfied.

In fact, today, users of such devices, to house it in a traditional suitcase in a way suitable to keep it safe from shocks and stresses, are used to cover it, possibly by all sides, with the softer products contained in the suitcase.

This operation is laborious and difficult to carry out, especially if user take out the device from the suitcase and insert it back again several times during the trip.

The problem underlying the present invention is to satisfy this need to store fragile products, such as electronic devices, in a suitcase in a way simple and safe for the products itself.

SUMMARY

Main aim of the present invention is to provide a suitcase which provides solution to this problem by preventing the drawbacks of traditional suitcases described above.

Within this aim, it is an object of the present invention to propose a suitcase which allows easy extraction of a fragile product stored therein an equally easy insertion of the same.

Another object of the present invention is to provide a suitcase which allows to obtain a good protection of fragile products housed therein resulting however lighter than and not as rigid as trolley type traditional suitcases.

Another object of the present invention is to propose a suitcase that avoids unauthorized extraction of a product contained therein.

This aim and these and other objects that will become better apparent hereinafter are achieved by a suitcase according to appended independent claim.

Detail features of the suitcase according to the invention are given in the dependent claims.

Further characteristics and advantages of the invention will become apparent from the description of a preferred not exclusive embodiment of the suitcase according to the invention, which is illustrated only by way of non limitative example in the attached drawings, in which:

BRIEF DESCRIPTION OF THE FIGS

DETAILED DESCRIPTION

Figure 1:
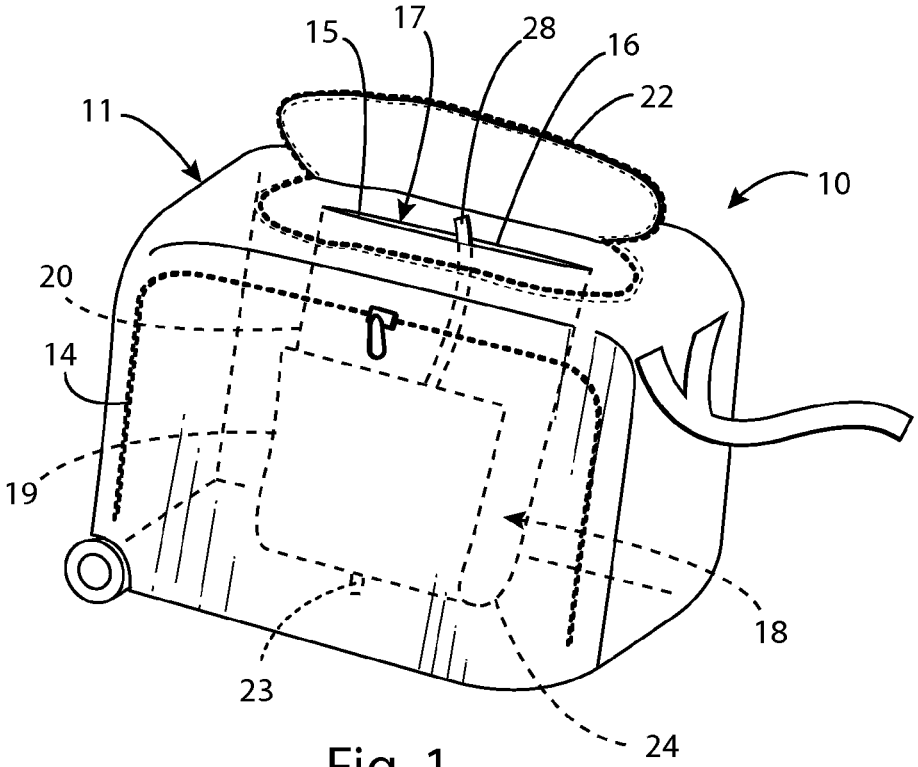
FIG. 1 shows a perspective view of a suitcase according to the invention.
Figure 2:
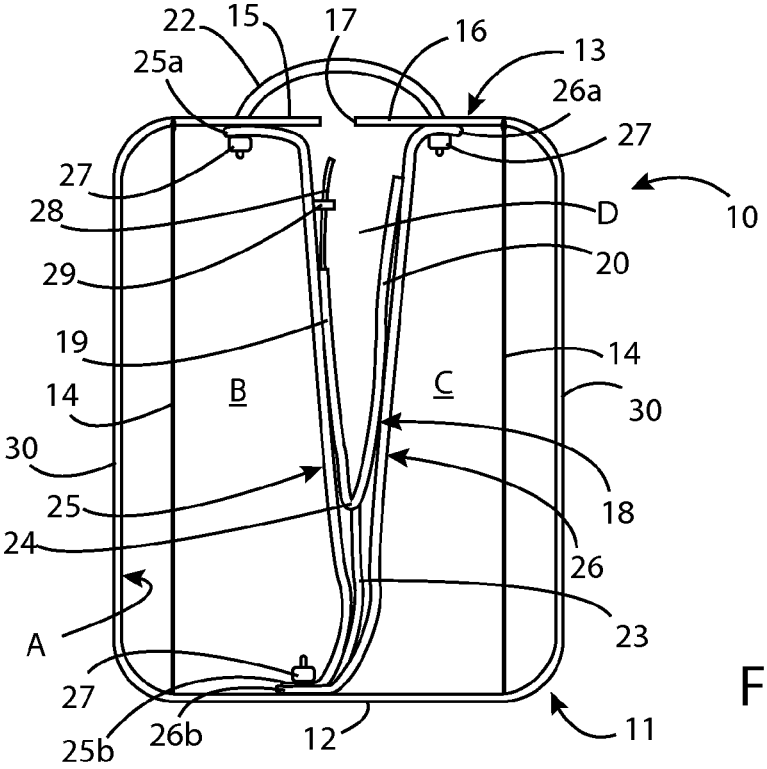
FIG. 2 shows a schematic simplified cross sectional view of another exemplary embodiment of the suitcase.

With particular reference to the above drawings, it is globally indicated with reference number 10 a suitcase preferably equipped with wheels and/or shoes to facilitate the dragging on the ground.

Structurally, the suitcase 10 comprises a container body 11 defining a hollow interior compartment A.

The container body has:

a supporting wall 12;

an upper wall 13 opposite to the support wall 12;

a first opening 14, which can be closed, for acceding to the compartment A.

The top wall 13 comprises two edges 15,16 adjacent each other which delimit a second opening 17, closable for example via a zipper, and in the fact that the suitcase 10 further comprises a support 18 having two flaps 19 and 20 folded over one another to form a U-shaped pocket which divides the compartment a in two half-compartment B and C, each of these flaps 19 and 20 being associated with a corresponding one of the edges 15 and 16 of top wall 13 and at least a first of the flaps 19 and 20 being slidable relative to its corresponding flap 15 or 16 to reduce or extend the depth of the pocket, for extracting, or for allowing the housing of a product in the pocket.

Preferably, the container body is equipped with two first openings 14 each adapted to allow access to a corresponding one of the two half-compartment B and C.

The second opening 17 is preferably at the center of the upper wall 13 and, advantageously, is constituted by a rectilinear slit which length is compatible to receive a laptop or an electronic tablet provided with the most common dimension among those on the market during the contingent period.

Preferably, the half-compartment B and C have substantially the same volume each other, i.e. the pocket divides the compartment A substantially into two equal parts so that a fragile product, such as an electronic tablet or a laptop PC, inserted in the support 18, is supported at the center of the suitcase 10 and is thus protected from shocks or stresses that might be exerted from the outside of the suitcase 10 itself.

The suitcase 10 advantageously comprises a cover 22 associated in a removable manner to the container body 11 above the second opening 17, to mask it.

The cover 22 may be associated to the container body 11 preferably by means of a zipper or via a Velcro® connection, or by means of hooks.

According to the invention, the bag 10 has a particular characteristic in the fact that are also provided resilient means 23 secured to the support 18 and to the support wall 12 to counter the sliding of flaps 19, 20 towards the second opening 17.

According to the embodiment of the invention shown in the accompanying figures, the elastic means 23 can be constituted by an elastic tape or by several elastic tapes possibly placed side by side.

The support 18 advantageously has a bottom 24 which connects the flaps 19 and 20; the elastic means 23 are preferably fixed to the bottom 24, to oppose the removal of the latter from the supporting wall 12 when the first flap 19 is pulled to extract a product from the pocket.

Advantageously, the suitcase 10 comprises two inner walls 25 and 26 that delimit a cavity D which houses the support 18.

Each inner wall 25 and 26 is preferably secured to a corresponding flap 15 and 16 of top wall 13 and both inner walls 25, 26 are fixed to the support wall 12.

Advantageously a first 19 of the flaps 19 and 20 of the support 18 is slidably associated to a first 25 of the inner walls 25 and 26 and the second 20 of the flaps 19 and 20 is fixed to the second 26 of the inner walls 25 and 26.

In alternative embodiments of the invention, both flaps 19, 20 can be slidably associated to corresponding inner walls 25 and 26.

Preferably there is provided a stop to the sliding of the first flap 19 inside the compartment A, suitable to prevent the bottom 24 of the support 18 to reach the supporting wall 12.

Said stop is advantageously constituted by a connection element, which preferably is elastic, fixed to the first inner wall 25 and to the first flap 19 of the support 18.

The inner walls 25 and 26 have:

- an upper border 25*a*, 26*a*, each upper border 25*a* and 26*a* advantageously fixed to one corresponding flap 15 and 16 of top wall 13 and
- a lower border 25*b*, 26*b*, each lower border 25*b* and 26*b* fixed to the support wall 12 and including stiffening ribs or slats 27 fixed to the upper and lower borders 25*a*, 25*b*, 26*a* and 26*b* to prevent the curling or crimping of the upper and lower borders 25*a*, 25*b*, 26*a* and 26*b*.

Advantageously, the bag 10 also comprises a pulling element 28, which for example can be constituted by elastic strips, fixed to the first flap 19 and associated to the first flap 15 on which are slidably guided, this pulling element 28 is adapted to be pulled to drag the first flap 19 toward the second opening 17.

Preferably said stop is constituted by a portion of the pulling element 28.

A guiding eyelet 29 is also advantageously provided, fixed to the first inner wall 25 and in which is slidably inserted the pulling element 28.

The flaps 19 and 20 are advantageously associated with the face of the upper wall 13 external to compartment A, thereby the flaps 19, 20 help extracting/inserting a product from/in said pocket, by guiding it.

Preferably the inner walls 25 and 26 are joined to one another and are removable from the container body 11 to allow separating the group constituted by the inner walls 25 and 26 and the support 18, which is interposed in between the latters, from the container body 11.

Preferably, said group is an independent product, which forms a PC case, attachable to and detachable from the container body through reversible connection means such as for example by zippers, Velcro® connections or pressure buttons and the like.

Functionally, a product may be housed in the pocket formed by the support 18 by inserting it through the second opening 17.

The support 18 supports the product spaced apart from the side walls 30 of the container body 11.

In addition, support 18 supports the product in a dampen way, thus alleviating any stress from the outside of the suitcase 10.

To extract the product from the bag 10, it is sufficient to open the second opening 17, to pull the pulling element 28 to protrude the product from the second opening 17 till it can be seized and then extracted the product.

Figure 3:
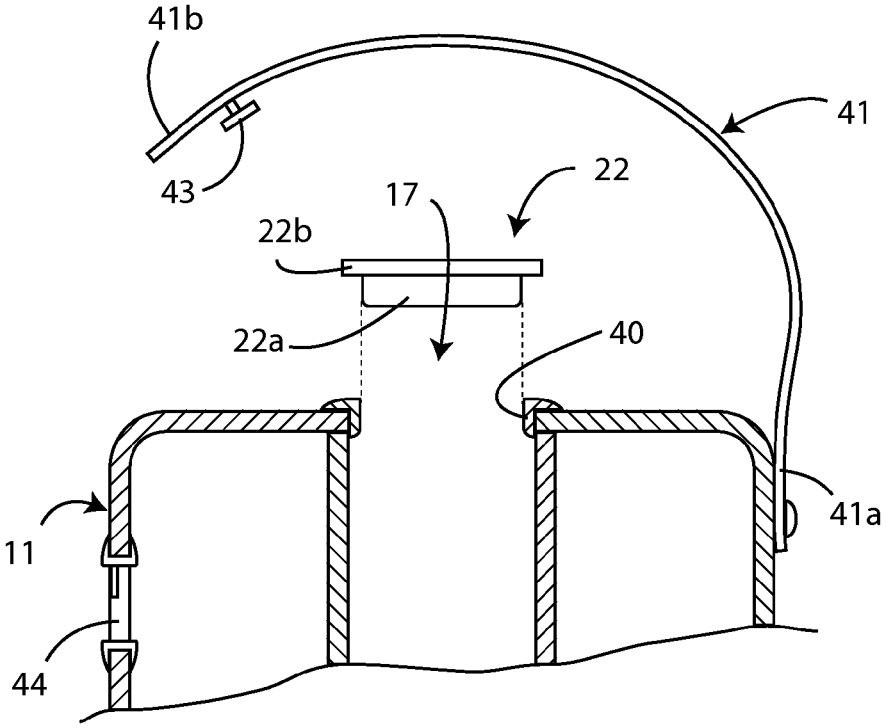
FIG. 3 shows a sectional view of an enlarged detail of an alternative exemplary embodiment of the suitcase.
Figure 4:
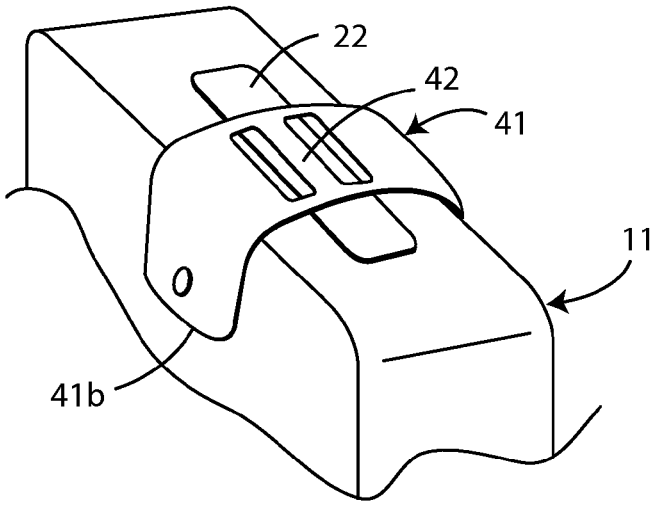
FIG. 4 illustrates a schematic view of the suitcase according to the invention, of FIG. 3.

In accordance with the embodiment illustrated by way of non limiting example in FIGS. 3 and 4, the suitcase 10 advantageously comprises a frame 40 fixed to the two portions 15 and 16 delimiting the second opening 17.

The cover 22 can be coupled with the frame 40 so as to seal the second opening 17.

Preferably, the cover 22 is rigid, for allowing an easy coupling to the frame 40, also when a single hand is used for coupling.

The cover 22 may comprise:

- a protrusion 22*a* adapted to be inserted, with interference, to the second opening 17;
- abutment edges 22*b*, suitable to abut with the frame 40 when the protrusion 22*a* is inserted into the latter.

Advantageously, the bag 10 also comprises a covering element 41 connected to the container body 11 and adapted to cover at least partially the cover 22 to prevent the removal of the second opening 17.

The covering element 41 is preferably removable from above the cover 22 to allow access to the second opening 17.

The covering element 41 consists of a band having a first end 41*a* fixed to the container body 11 and a second end 41*b* fixed to the container body 11.

The covering element 41 also advantageously has a handle 42 provided in an intermediate position between the ends 41*a* and 41*b* and adapted to be grasped by a user to lift the suitcase 10.

Preferably, the second end 41*b* is provided with a coupling element 43 adapted to be removably coupled to a coupling seat 44 which is provided on the container body 11.

In practice, the configuration of the covering element 41 allows the use of the latter both as security device to prevent unauthorized access to the second opening 17 and at the same time provides a handle to hold the suitcase 10.

FIG. 4 illustrates a configuration in which the covering element 41 is coupled to the container body 11 and covers the cover 22 so as to prevent the removal thereof from the second opening 17.

The present invention achieves the intended aim and objects allowing realizing a suitcase which allows easy extraction of a fragile product stored therein and an equally easy insertion of the same product.

A suitcase according to the present invention allows to obtain an effective protection of fragile products housed in it as these are supported, in a dampen way, centrally to the compartment of the suitcase.

In addition, a suitcase according to the invention is equally light and not rigid as the traditional type trolley suitcases.

A suitcase according to the invention also allows to avoid unauthorized extraction of a product contained therein, allowing to hide the opening from which the product is removable.

The invention thus conceived is susceptible of numerous modifications and variations, all within the scope of protection of the appended claims.

For example the faces of the inner walls on which rest and/or slide the flaps of the support can be realized in an aesthetically pleasing material and/or in a material that facilitates the sliding of the flaps, to make easier the extraction from the suitcase of a product housed therein.

Further, all the details may be replaced with other technically equivalent elements.

In practice, the materials used as well as the contingent shapes and dimensions, may be any according to requirements and to the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A suitcase comprising: a hollow container body defining an internal compartment and further comprising:

a supporting wall;

an upper wall opposite to said supporting wall;

a first opening, closable, for access to said compartment; wherein said upper wall comprises two edges adjacent each other delimiting a second opening closable and central to said upper wall, said suitcase further comprising a support having two flaps folded one over the other to form a U-shaped pocket which divides said compartment in two half-compartments, each of said flaps being connected with a corresponding one of the edges of said upper wall and at least a first of said flaps being slidable with respect to its corresponding first edge to reduce or extend the depth of said pocket for the extraction or the housing of a product in the latter; wherein the suitcase further comprises elastic means fixed to said support and to said supporting wall to oppose the sliding of said flaps towards said second opening.

2. A suitcase according to claim 1, wherein said half-compartments have substantially the same volume.

3. A suitcase according to claim 1, further comprising a cover removably connected with said container body over said second opening to mask said second opening.

4. A suitcase according to claim 1, wherein said support has a bottom which connects the flaps to each other, said elastic means being fixed to said bottom to oppose the spacing of the latter from said supporting wall.

5. A suitcase according to claim 1, further comprising two internal walls delimiting a cavity that houses said support, each of said inner walls being fixed to a corresponding one of the edges of said upper wall and both said inner walls being fixed to said supporting wall.

6. A suitcase according to claim 5, wherein a first of the flaps of said support is slidably associated with a first of said inner walls, the second of said flaps being fixed to the second of said inner walls.

7. A suitcase according to claim 5, wherein said inner walls have an upper border fixed to a corresponding edge of the upper wall and a lower border fixed to the supporting wall and comprise stiffening slats fixed to said edges to prevent the curling of the latter.

8. A suitcase according to claim 1, further comprising a tie element attached to said first flap and associated in a sliding manner and guided to said first edge, adapted to be pulled to drag said first flap towards said second opening.

9. A suitcase according to claim 8, further comprising a guiding eyelet fixed to said first inner wall and in which is slidably inserted said tie element.

* * * * *